US008654142B2

(12) United States Patent
Beeman et al.

(10) Patent No.: US 8,654,142 B2
(45) Date of Patent: Feb. 18, 2014

(54) ACCURATE COLOR DISPLAY DEVICE

(75) Inventors: Ed Beeman, Fort Collins, CO (US); Bob Myers, Loveland, CO (US); John Frederick, Spring, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 183 days.

(21) Appl. No.: 13/258,501

(22) PCT Filed: May 29, 2009

(86) PCT No.: PCT/US2009/045696

§ 371 (c)(1),
(2), (4) Date: Sep. 22, 2011

(87) PCT Pub. No.: WO2010/126533

PCT Pub. Date: Nov. 4, 2010

(65) Prior Publication Data

US 2012/0013635 A1 Jan. 19, 2012

Related U.S. Application Data

(63) Continuation-in-part of application No. 12/433,059, filed on Apr. 30, 2009, now Pat. No. 8,390,642.

(51) Int. Cl.
*G09G 5/02* (2006.01)

(52) U.S. Cl.
USPC ..... 345/590; 345/605; 345/589

(58) Field of Classification Search
None
See application file for complete search history.

(56) References Cited

U.S. PATENT DOCUMENTS

| | | | | |
|---|---|---|---|---|
| 8,194,095 | B2 * | 6/2012 | Imai et al. | 345/590 |
| 2004/0169659 | A1 * | 9/2004 | Kagawa et al. | 345/600 |
| 2004/0212610 | A1 * | 10/2004 | Hamlin | 345/211 |
| 2008/0018834 | A1 * | 1/2008 | Matsushima et al. | 349/98 |
| 2008/0259369 | A1 * | 10/2008 | Kanai et al. | 358/1.9 |
| 2009/0040573 | A1 * | 2/2009 | Lee | 358/505 |
| 2010/0165660 | A1 * | 7/2010 | Weber et al. | 362/609 |
| 2010/0171906 | A1 * | 7/2010 | Sakai | 349/96 |

FOREIGN PATENT DOCUMENTS

| | | |
|---|---|---|
| JP | 2002-116750 | 4/2002 |
| JP | 2007-017862 | 1/2007 |

OTHER PUBLICATIONS

Roth, "Review: HP LP2275w" on Oct. 9, 2008. The article was retrieved from http://www.prad.de/en/monitore/review/2008/review-hp-lp2275w.html on May 16, 2013.*

* cited by examiner

*Primary Examiner* — Kee M Tung
*Assistant Examiner* — Yi Wang

(57) ABSTRACT

A color accurate display device is configured to receive an encoded first color space having a first gamut from a set of encoded primaries {R, G, B} and a first white point. The device includes a display panel having an active area configured for an encoded second color space having a second white point and a set of native primaries each with a characterized tone response with respect to the second color space and a measured tone response from the display panel, the primaries having a second gamut larger than and including the first gamut. Also included is a color space conversion circuit configured to convert the set of encoded primaries {R, G, B} and first white point of the first color space to the set of native primaries and second white point compensating for each characterized tone response of the second color space.

18 Claims, 8 Drawing Sheets

| Input Value | 2.4 Gamma Output (12-bit (0-4095)) | Corrected Gamma Output (12 bit (0-4095)) | Difference |
|---|---|---|---|
| 0 | | 0 | 0 |
| 1 | 0 | 1 | 1 |
| 2 | 0 | 2 | 2 |
| 3 | 0 | 3 | 3 |
| 4 | 0 | 4 | 4 |
| 5 | 0 | 5 | 5 |
| 6 | 0 | 6 | 6 |
| 7 | 1 | 7 | 6 |
| 8 | 1 | 8 | 7 |
| 9 | 1 | 9 | 8 |
| 10 | 2 | 10 | 8 |

ACCURATE COLOR DISPLAY DEVICE

CROSS-REFERENCE TO RELATED APPLICATIONS

This application is a continuation-in-part of U.S. patent application Ser. No. 12/433,059, filed Apr. 30, 2009 now U.S. Pat. No. 8,390,642 entitled "SYSTEM AND METHOD FOR COLOR SPACE SETTING ADJUSTMENT", and which is incorporated by reference herein.

BACKGROUND OF THE INVENTION

Conventional studio-quality CRT (cathode ray tube) monitors are used to view accurate color presentations such as in medical diagnosis, filmmaking, artwork development, video creation, and other color intensive applications. However, common CRTs are being phased out of the consumer and computer marketplaces due to improvements in other technologies such as larger viewing areas, higher resolution, and different form factors that customers desire. This change means that CRTs are no longer a mass production technology. The already expensive studio-quality versions are rapidly increasing in price or becoming unavailable altogether. Many of the new replacement display technologies, such as LCD (liquid crystal display), plasma, OLED (organic light emitting diode) and projection systems have difficulty in presenting as accurate colors in comparison to the CRT, especially over wide viewing angles and uniformly across the display.

Due to the standardization of the sRGB color space on the Internet, many computers, printers, scanners, and cameras use sRGB as a default working color space. While consumer level LCDs may be labeled as sRGB, one cannot conclude that the image viewed is color accurate on the LCD as their variability is widely known.

BRIEF DESCRIPTION OF THE DRAWINGS

The invention is better understood with reference to the following drawings. The elements of the drawings are not necessarily to scale relative to each other. Rather, emphasis has instead been placed upon clearly illustrating the invention. Furthermore, like reference numerals designate corresponding similar parts through the several views.

DETAILED DESCRIPTION

Figure 1:
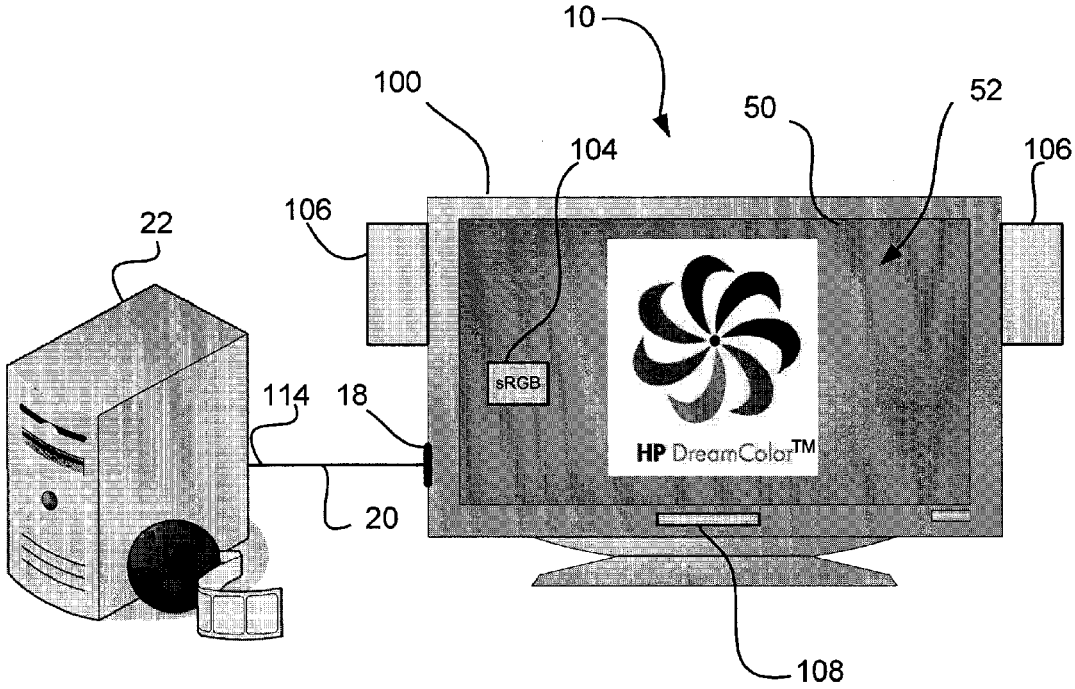
FIG. 1 is a diagram of an exemplary color accurate display embodied as a display device connected to a driving source in one embodiment.

The claimed subject matter solves the problem of expensive and nearly unavailable studio-quality color CRT monitors by creating a new architecture for display devices. This architecture delivers high accuracy color by bringing together a number of various aspects of color manipulation and control to provide accurate emulation of a variety of color spaces even when viewed off-axis to the face of a display. Display panels, monitors, and other devices that meet the claimed subject matter are able to satisfy the color critical needs of several industries and to give ordinary consumers a guarantee of accurate color presentation. The embodied color accurate displays provide flexible yet accurate multiple color space renderings that can meet the requirements of several applications thereby eliminating the need to have several different monitors with very different color characteristics. This capability helps to reduce the cost of studio quality monitors such that now very accurate color reproduction can be incorporated into conventional consumer video devices such as projectors, televisions, computers, and video games, just to name a few. This incorporation into consumer devices allows a user to not have to make complicated and unpredictable color adjustments. The dream of consistent and accurate color (aka "DreamColor™") as intended by the creators of media has been a long sought goal for consumers and traditionally has only been available to high-end developers. This consumerization of high performance color rendition allows the content producers, publishers, and distributers to deliver accurate, predictable, and consistent color without the need for constant adjustment by users. This result ensures that the added cost of creating high quality color productions will not be wasted or ruined by poor rendering due to inadequate consumer display technology found on conventional consumer video displays today.

DEFINITION OF TERMS

Color—the perception of light incident upon the retina of a human in the visible region of the spectra having wavelengths in the region of 400 nm to 700 nm.

CIE—Commision International de L'Eclairage, an international color standards body.

Display Panel—also interchangeably referred to as a display module. This display panel/module refers to the component that contains the glass or plastic and liquid crystal or other light modulation material, drive electronics and optionally a backlight. While the main embodiments discussed herein will generally refer to LCD (liquid crystal display) panels, other light modulators such as OLED, plasma, LEDs, and projection systems can be encompassed by the claimed subject matter.

Display Device—refers to the final product that contains a display panel/module along with the host driving circuit interface electronics, firmware, possibly an on-screen display or other indicators and final packaging. A display device may be a display monitor or also include any video driving circuitry or video source such as a tuner, computer, or other electronic device.

Tone response—refers to the characteristic mapping of luminance between the input data and the output response. A gamma function is a form of tone response. The term tone response is a more general term that encompasses transfer functions that are not a simple exponential response. A tone response may actually be different than a traditional power function and include various linear, piece-wise sections, offsets, or other video input to video output mapping function. Each color channel in a display device may have a potentially different tone response from each other.

Gamma—is the ratio of the derivative of the log of the video output to the derivative of the log of the video input usually expressed as a power (exponential) function. Because the intensity of light generated by a physical device is rarely a linear function of the input signal, a method of expressing the ratio is required. A conventional CRT has an exponential response such that the intensity at the screen is the input voltage raised to the 2.2 power that serendipitously closely matches the human eyes inverse log response. This power function is conventionally known as "gamma."

Gamut—is the set of colors (or pallet) that a display device is able to reproduce which is typically a sub-set of the total colors that are possible for a human eye to detect. The subset is less than the total possible typically due to the use of a limited set of primaries in a display that are not only non-pure chromaticities but also unable to encompass the complete space of colors due to having only three primaries. The use of more pure or additional primaries and their location on the CIE chromaticity diagram (see FIG. 4) allows for a wider gamut display.

Color space—is a term used to describe a specification that encodes a way of describing a set of colors using a set of at least three parameters to create a desired perceived tone response. There are various ways of encoding colors which, depending on the application, are quite helpful for computation purposes or to maintain certain objectives such as color differentiation. sRGB is a well known color space specification for computer monitors and Internet applications originally created by Microsoft and Hewlett-Packard. Other typical color spaces are Adobe™RGB which provides a simple gamma curve with gamma=2.2 and no offset. Digital Cinema (DCI) P3 ref. projector spec. provides a simple gamma curve with gamma=2.6 and no offset. ITU Rec. 601 (also known as "SMPTE-C") can be expressed as a simple gamma curve with gamma=2.4 with no offset. ITU Rec. 709 ("HDTV") can be expressed as a simple gamma curve with gamma=2.4 with no offset.

Color filters—are optical filters arranged in an array of RGB on a display panel to filter the backlit light in a transmissive panel or to filter ambient light in a reflective panel. In an LCD, the liquid crystal material is modulated with an electric field to change the polarization of light that is able to pass between two differently oriented polarized sheets on the front and back of the display. That is, light from the backlight (non-polarized) is transmitted through a back polarizer, the liquid crystal display (a programmable polarizer) and the front polarizer. As the liquid crystal material is modulated, the amount of light transmitted through the front polarizer changes. This light is passed through one of the RGB display filters for each pixel. The light from the set of RGB display filters combines to form the color of light seen from the pixel. The primary selections have a direct correlation with the selection and accuracy of the color filters.

Figure 2:
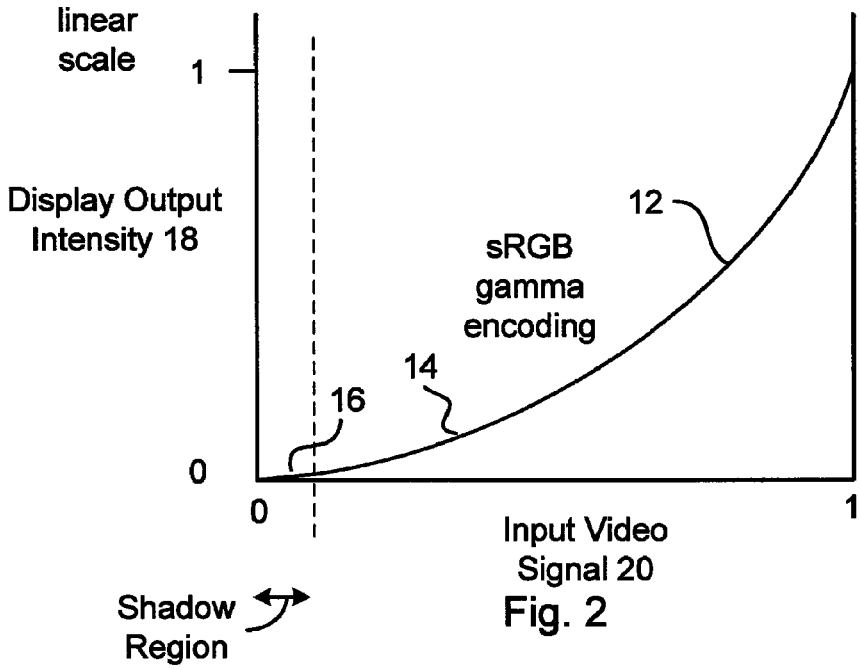
FIG. 2 is a diagram illustrating a transfer curve for a display device's gamma function, in one embodiment.

Primaries—are the tri-stimulus (or multi-stimulus) chromaticity values that reach the retina of the eye of a human. The various combinations of intensity levels of the primaries and how they are perceived by the human eye determine the set of colors in the gamut of available colors a display is able to reproduce or render. Although three primaries are common, more than three primaries may be used to increase the gamut of colors.

sRGB color space—is an industry standard Red, Green, Blue color space created by Microsoft and Hewlett-Packard for use on monitors, printers, and the Internet. FIG. 2 is a graph illustrating the sRGB gamma 12 used in some embodiments. An input video signal 20 is applied to a display to create display output intensity 18. The sRGB gamma 12 is not a single number like most other color space with simple gammas. While the overall response is a power exponent of approximately 2.2, the sRGB gamma 12 is a combination of a linear portion 16 and an exponential (non-linear) portion 14 with offset as illustrated. The linear portion 16 has a gamma of 1.0 near the black point or otherwise known as the "shadow region." Having a linear relationship allows the fine detail of the image when the output of a display is low to be perceived better by the user. For instance, scenes of Batman fighting at night come alive in movies when using an sRGB encoded color space. The non-linear section 14 elsewhere includes a 2.4 exponent.

R'G'B' color space—in this specification is an extended bit-depth linear color space that is a decoded version of the presented encoded color space from a driving source. The actual bit-depth depends upon the application and the selection of supported color spaces. For an 8-bit sRGB encoded drive signal, the extended bit-depth may be at least 12 bits in order to preserve color accuracy through the color processing pipe-line in the color space conversion circuitry.

R"G"B" color space—in this specification is an extended bit-depth linear native color space. Due to various color space encodings, the actual RGB chromaticities of the drive source may be different than the native RGB chromaticities of the display panel. Accordingly, the conversion of the drive space RGB chromaticities to the native RGB chromaticities can be performed with a 3×3 matrix multiplier, 3D look-up table, or other math operation implementation. The coefficients for the 3×3 multiplier or 3D look-up table are programmed specifically for the display panel in question using the primary chromaticity information measured for the panel with respect to the desired color space specified primary chromaticity values. The 3×3 matrix multiplier or other linear math computations are also performed at the extended bit-depth of the R'G'B' color space. The final result may be bit-truncated to match the input bit-depth resolution of the display panel. Alternatively, bit dithering circuitry may be included to encode a higher bit depth into a temporally modulated lower bit-depth input.

CIE XYZ—is a CIE 1931 color space that can predict which spectral power distributions will be perceived by the human eye as the same color but which is not particularly perceptually uniform. Perceptually uniform means that the change of the same amount in a color value produces a change of about the same visual importance. The eye has cone cell receptors for three wavelengths for color sensation which overlap. The tri-stimulus values of a color are the amounts of three primary colors {R, G, B} in a three-component additive color model needed to match a desired color. The tri-stimulus values are most often given in the CIE 1931 color space, in which they are denoted X, Y, and Z. Any specific method for associating these tri-stimulus values with each color is called a color space. CIE XYZ, one of many such spaces, is special because it is based on direct measurements of human visual perception, and serves as the basis from which many other color spaces are defined.

Figure 4:
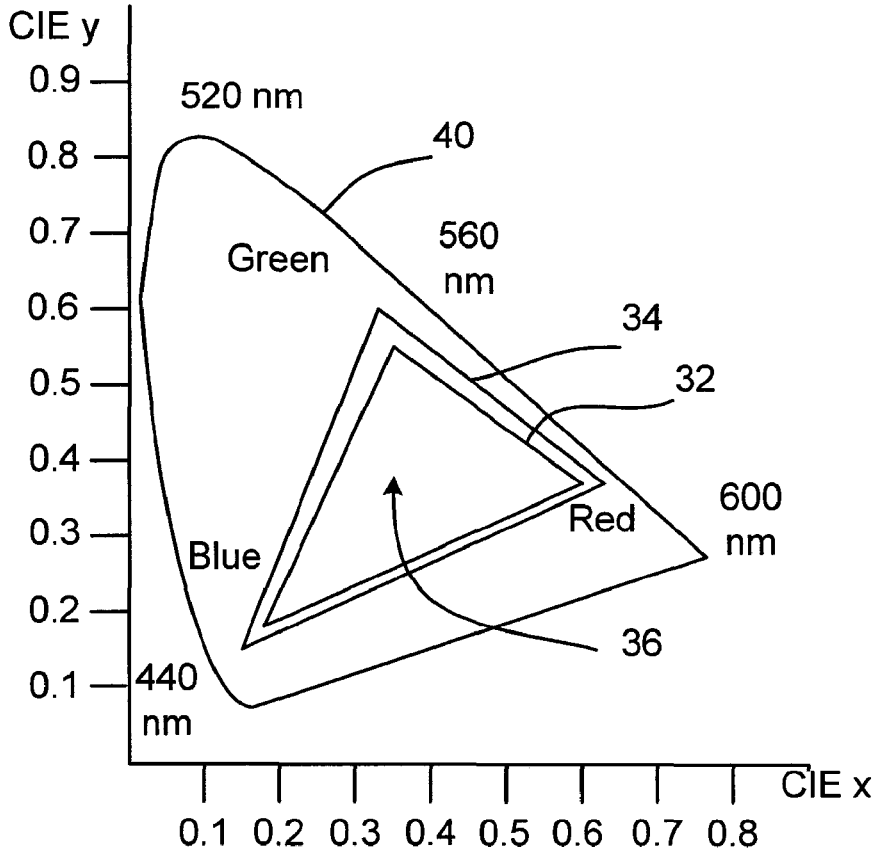
FIG. 4 is a diagram of a 1931 CIE xy Chromaticity diagram and a set of first primaries and a set of second primaries that encompass the set of first primary's color space in one embodiment.

CIE x and y components—It is often convenient to discuss "pure" color in the absence of brightness. The CIE defines a normalization process in terms of little x and little y coordinates where:

$$x = \frac{X}{X+Y+Z} \qquad y = \frac{Y}{X+Y+Z}$$

which create a color plot as a point in an (x, y) chromaticity diagram (see FIG. 4).

CIELUV and 1976 u' v' components—CIELUV color space is a CIE defined color space that attempted to have perceptual uniformity. It had difficulty with accurately determining color with additive mixtures of light on the CIELUV color space unless the mixtures are constant in lightness. The 1976 u'v' coordinates can be converted to 1931 xy coordinates by the following:

$$x=9u'/(6u'-16v'+12)$$

$$y=4v'/(6u'-16v'+12)$$

CIELAB—is known as LAB color space, a color-opponent space with dimension L* for lightness and a* and b* for the color-opponent dimensions, based on non-linearly compressed CIE XYZ color space coordinates and can be computed with simple formulas from the CIE XYZ space. The three coordinates of CIELAB represent the lightness (defined below) of the color (L*=0 yields black and L*=100 indicates diffuse white whereas specular white may actually be higher), its position between red/magenta and green (a*, negative values indicate green while positive values indicate magenta) and its position between yellow and blue (b*, negative values indicate blue and positive values indicate yellow). The asterisk (*) after L, a and b are part of the full name, since they represent L*, a* and b*, to distinguish them from Hunter's L, a and b, yet another well-known color space. Calculations or measured values using L*, a*, and b* also include the asterisk.

When storing colors in a limited precision values, this LAB color space can improve the reproduction of tones. The CIELAB color space is relative to the white point of the CIE XYZ data it is converted from. In this specification, the default white point is $D_{65}$ although others could be used. The CIELAB color gamut is designed to approximate human vision and the L* component closely matches the human perception of lightness. The CIELAB color space is much larger than the gamut of human vision and thereby encompasses the gamut of color spaces to be rendered on a display panel. The color space conversion to other color spaces is well known to those of skill in the art (i.e. IEC/4WD 61966-2-1: Colour Measurement and Management in Multimedia Systems and Equipment—Part 2-1: Default RGB Colour Space—sRGB). For sRGB conversion, L* ranges from 0 to 100 and the possible coordinate ranges for a* and b* are [−0.86, 0.98] and [−1.07, 0.94], respectively. CIELAB values are the default measured values used herein as denoted by the asterisk unless noted otherwise.

Luminance—is a CIE defined term (Y) that is used to denote the radiant power of a light source weighted by a spectral sensitivity function that is a characteristic of human vision. That is, the human eye does not see all colors equally well; therefore the brightness of a light source needs to be compensated by how the eye perceives it rather than just a straight electrical meter reading of the watts per square meter which would be a measure of "intensity" of the light. For linear primaries of RGB, the luminance for ITU Rec. 709 ("HDTV") can be computed as:

$$Y_{709}=0.215R+0.7154G+0.0721B$$

Lightness—is the human perceptual response to luminance and is defined by CIE as a linear segment of luminance near black and a modified cube root of luminance elsewhere:

$$L^* = 116\left(\frac{Y}{Y_n}\right)^{1/3} - 16;\ 0.008856 < \frac{Y}{Y_n}$$

$$L^* = 903.3\left(\frac{Y}{Y_n}\right);\ \frac{Y}{Y_n} < 0.008856$$

where $Y_n$ is the luminance of the white reference. For L* with a range of 0 to 100, an L* of 1 is roughly the threshold of visibility.

Color Difference—throughout the specification, the color difference equation of choice is $\Delta E^*_{ab1994}$ as defined by the CIE. To compensate for variation in human perceptual sensitivity, the CIELAB color space is used for display color measurements due to the lack of a standardized color difference equation for CIELUV, commonly used by display manufactures. Since CIELAB differences correspond to perceptual differences, the relative perceptual difference between any two colors in CIELAB can be treated as taking the Euclidean distance between the three L*, a*, b* components of two colors. When luminance alone is important, a luminance difference ΔL* is used where $\Delta L^*=L^*_1-L^*_2$. When considering neutral-axis color drift, luminance is ignored and since the reference has no hue, the color difference is reduced to the chroma difference $\Delta C^*_{ab}$ where:

$$C_1=\sqrt{a_1^2+b_1^2},C_2=\sqrt{a_2^2+b_2^2},\Delta C^*_{ab}=C_1-C_2.$$

The color difference or ΔE* between a sample $L_2a_2b_2$ and a reference color $L_1a_1b_1$ is:

$$\Delta E^* = \sqrt{(\Delta L)^2 + \left(\frac{\Delta C}{S_C}\right)^2 + \left(\frac{\Delta H}{S_H}\right)^2}$$

$$\text{where: } \Delta H = \sqrt{\Delta a^2 + \Delta b^2 - \Delta C^2}$$

$$S_c = 1 + 0.045(C_1)\ S_H = 1 + 0.015(C_1)$$

$$\Delta a = a_1 - a_2\ \Delta b = b_1 - b_2$$

Color Accuracy—is also how well a measured color (or perceived color) from a display matches an expected value. Color tolerance concerns what set of colors are imperceptibly permitted to be accepted as an acceptable expected color. If the color difference measured is perceptually uniform, such as with CIELAB, the set of points whose distance to the reference is less than a just-noticeable-difference (JND) threshold falls within the color accuracy of the color.

Shadow region detail—is the discernable perceptual difference at low luminance values. If a true exponential gamma (simple gamma) is used, there is little change in the intensity of light from a display with respect to the value of the input in low luminance situations. By using a linear region near the black point for simple gamma color spaces, the detail in those lower levels can be made more perceptible to a user. The sRGB color space defines such a region as do some other color spaces, although they are often ignored due to studio manipulation of the display data in the low luminance conditions. This application allows for smoother shadow region detail in simple gamma color spaces by linearizing the look-up table data in the shadow region.

Color banding—is also known as "mach banding." This banding is a display artifact that manifests itself as various bars of color rather than a true graduation. The banding is generally due to either rounding of the least significant bits in the image pipeline or the inability of a display to adequately render the lower bits of color presented to it.

White point—The white point is the chromaticity of a color reproduced by equal or near equal primary components. The white point is a function of the ratio of power among the primaries. For this specification, the approximate daylight CIE specified illuminate $D_{65}$ is a reference from which other color accuracy and differences can be derived. Other white point reference may be used and still fall within the scope of the claimed subject matter.

EDID signaling—is short for Extended Display Identification Data. EDID is a data structure defined by a standard published by the Video Electronics Standards Association (VESA). The EDID includes the manufacturer name, serial number, product type, color generation info, timings supported by the display, display size, luminance data, and pixel mapping data. The electrical signaling used is generally the $I^2C$ bus standard which is known to those of skill in the art. The EDID data structure is normally stored in a memory device that is compatible with the $I^2C$ bus. Other electrical signaling and memory devices can be used and still meet the scope of the claimed subject matter.

Look-up-Table (LUT)—is a transform device to convert one set of numbers to another. A LUT may be implemented in hardware or software and generally is implemented as a memory device where the input is the address to the device and the output is the data read from that applied address. A LUT may also be implemented by logic circuits or it may be calculated or emulated with a processing unit running firmware, microcode, or software. A look-up table may be for one color or multiple colors. A look-up table for a set of three colors can be referred to as a 3D look-up table.

3×3 Multiplier—is a logic circuit that transforms a set of three inputs into a set of three outputs by performing a series of linear algebra operations and usually is expressed in matrix form. A 3×3 multiplier may be implemented in hardware, software, or a combination of both.

Native mode is the default color space of a display panel based on the gamut of colors that its "native" primaries are able to reproduce. A display device operating in native mode would have no or little color processing performed on the input data that is presented to the device. However, to provide the best possible color accuracy, a display device operating in "Native mode" may have the native primaries corrected for individual differences in gamma by converting the input signal with an inverse transform of the measured color space of the display panel. The 3×3 multiplier is also used to correct for any measured primary color difference from the specified desired color space tri-stimulus values Bit depth—is the number of bits of information used to encode binary data for a color channel.

Exemplary Embodiments

As an example, FIG. 1 is a diagram of an accurate color display 10 embodied as a display device 100. The display device 100 includes a characterized display panel 50, 50' that is mounted in a mechanical housing 102 along with color space conversion (CSC) electronics 11 (FIG. 8) to provide the "DreamColor" functionality of accurate color space rendering. The display device 100 may also include a set of speakers 106 to allow for audio as well as video on the display panel 50. The display device 100 may also include switches or other input devices 108, including remote controls, used to set particular color space settings or modes as well as other device options. The display device 100 may also include an on-screen display 104 to display the current color mode settings or the status of other device options. A video driving source (and possibly audio) 22 is used to provide a static, moving, partial, or whole frame of video in a desired color space, such as sRGB input video signals 20 over a video link 114 (HDMI, DVI, and others known to those skilled in the art) to an input port 112 on the display device 100. While digital video links are desired, the video driving source may also include analog video signals which would be A/D sampled in the device to create digitized signals. Possible video driving sources include computers, television receivers, cameras, video cameras, medical equipment, graphic servers, and even cell phones to name a few.

As noted, there are several aspects of color manipulation which can be used to provide this "DreamColor™" functionality of consistent accurate color rendition. Conventionally, most video connections only support an 8-bit-per color interface to the video display. Nevertheless, the claimed embodiments are not limited to just 8-bit color. With a conventional Red-Green-Blue (RGB) set of primaries this is known as 24-bit (8×3) "True-color" display. The embodiments described within may make much more effective use of these 24 bits by performing color space manipulation using extended bit-depth hardware in a linear color space. For instance, these 24 bits are presented to a display traditionally in a gamma encoded color space format, such as sRGB, Adobe™RGB, Rec. 709 (HDTV), SMPTE-C, SMPTE-431-2, or other standard. The claimed embodiments may take such an encoded format and convert the 24 bits to an extended bit-depth, such as a 36 bit wide (3×12) R'G'B' linear color space. This extended bit-depth R'G'B' linear color space is used to reorder the encoded color space into a set of extended bit-depth R"G"B" linear native color primaries using a 3×3 matrix multiplier, 3D look-up table or similar circuit/software. The set of extended bit-depth R"G"B" linear native color primaries are then individually encoded into a set of native encoded primaries having individual tone responses for a display panel. That is, each native primary has a unique and likely different tone response used by the display. To create this multi-tone response encoding, the native primaries of a display device are characterized for their individual chromaticity and actual measured tone response and the data used to provide the 3×3 multiplier coefficients and the multi-gamma encoding look-up tables (FIG. 8A) for the linear primaries to the native primaries. Alternatively, a 3D look-up table can be used (FIG. 8B).

The display panel in the display device is first selected such that it has a set of primary locations which encompasses any desired color space gamut the display device is to replicate. Conventional color LCD displays are now being created with gamuts that are more saturated (super-saturated) than traditional monitors. However, the conventional accuracy of such displays result in the wider gamuts being under-utilized and improperly presented. In fact, a user usually is left responsible for adjusting the display controls to achieve the "desired color." One problem identified by the inventors is that each the primaries in such super-saturated displays often have a different tone response from the other primaries leading to unpredictable color response. Such a display is characterized to determine the color chromaticity and tone response for each primary. Matrix coefficients are created for the color space conversion circuit to shift white point of the input primaries of the desired color space to the white point of the characterized actual primaries of a particular display panel. The measured tone response of each primary is used to program a set of post-LUT circuits that convert linear intensity data to the individual panel primary tone response. This multi-primary chromaticity shifting for white point and individual tone response encoding scheme allows the extended bit-depth linear primaries to be faithfully and effectively reproduced. Essentially, the display device's ideal tone response now becomes the tone response used in the pre-LUTs to convert the incoming driving source color space as most differences between the display panel primaries have been compensated for.

To ensure color accuracy when viewed from a variety of vantage points, displays should be measured from a variety of predefined angles to ensure that color accuracy to a targeted specification is met. Conventionally, the only off-axis measurement done to a display is to ensure that at a single angle, the measured contrast ratio has dropped less than 10% of the measured contrast ratio when viewed perpendicular to the active area of the screen. This conventional measurement method is wholly inadequate for ensuring accurate color. The methods of testing off-axis luminance and color uniformity included herein do so using multiple locations around the perpendicular axis and ensure a consistent color difference is met at one or more angles, across the display and within various distances between locations on the display active area.

The embodiments may also include additional circuitry to allow for the individual setting of multiple tone responses which may be preset or downloaded into the pre-LUT. Such tone responses can include those with simple gamma functions, linear plus gamma with offset (sRGB), and downloadable curves. To help the drive source (such as a tuner, computer, camera, etc.) provide a proper color response, an EDID circuit can be provided that is dynamically updated to reflect the color characteristics of the currently selected color space settings for a display device. In addition, user controls may be provided to allow a user to select between color-managed and Native modes of the display. These and other features are described in more detail in the following description of the claimed subject matter.

It should be noted that the drawings are not true to scale. Further, various parts of the active elements have not been drawn to scale or detail. Certain dimensions have been exaggerated in relation to other dimensions in order to provide a clearer illustration and understanding of the disclosed embodiments.

In addition, although the embodiments illustrated herein are shown in two-dimensional views with various regions having depth and width, it should be clearly understood that these regions are illustrations of only a portion of a device that is actually a three-dimensional structure. Accordingly, these regions will have three dimensions, including length, width, and depth, when fabricated. It is not intended that the devices of the present embodiments be limited to the physical structures illustrated. These structures are included to demonstrate the utility and application of the claimed embodiments.

Although the claimed subject matter is described herein primarily with the use of an LCD display panel, other display panel technology or display devices, in general may be used and still meet the claimed subject matter. For instance, OLED technology may be used to create three or more primaries using organic material to create a set of light sources that define a native mode color space. LED displays may be used to create a set of three or more primaries using inorganic semiconductor material. Plasma displays may use electron excited phosphors to create a set of native primaries for display. Other display types may create primaries using dyes or pigments in additive or subtractive manners. These display native mode color spaces can be incorporated with the front-end CSC electronics for color space conversion and the overall architecture described herein to provide an accurate color display device.

Advantages

The claimed embodiments provide a color display or device 100 using a display panel 50, 50' (such as an LCD panel) that provides an extremely accurate and predictable color output to a variety of color spaces with minimal effort in terms of set-up on the part of the user of the display even when connecting to multiple input devices. This innovative method and apparatus for driving a display device 100 allows prior users of specialized CRT technology to meet the demanding needs of their most color critical markets. Further, it allows typical consumers the advantage of consistent accurate color without the need for continual setup and tweaking of controls. In order to make a variable color display such as an LCD display panel provide color accuracy, a number of different tests, characterizations, programming, and circuit changes are used other than that done in the display industry in order to replicate accurately the desired tonal responses over a wide range of viewing angles comparable to the rendition of earlier specialized CRT technology.

In order to deliver consistent color accuracy, careful attention to detail is followed from the reception of data representing the desired color space to the actual displayed color space. The embodiments described bring together a number of various aspects of color manipulation and control to ensure that the color rendered by an LCD or other display panel 50, 50' faithfully and consistently represents the desired color space presented on the display device from a driving source 22. The display device 100 has two main components which together provide the desired color accuracy. These is an LCD or other display panel 50, 50' that is specified, characterized, and tested to ensure that it provides a gamut of colors over multiple viewing angles and across the display faithfully. The second component is a color space conversion circuit that faithfully translates the desired color space presented to the display device 100 into the actual color space of the display panel 50, which is slightly different for each display panel. This transformation is done by first converting the desired color space into an idealized linear color space and then converting the idealized color space into the characterized color space of the display panel 50, 50' including both individual chromaticity and gamma for each primary. By having such a color space conversion circuit, various different color spaces can accurately be emulated by the display device 100. In addition, new, unique, or other desired color spaces may be downloaded to the display device 100 and used to faithfully reproduce color on the display panel 50.

In one embodiment, the currently configured color space on the display device 100 can be reported to the driving device using a dynamic EDID circuit in order to allow the driving device to provide the proper color space to the display device 100. Having such a programmable and reportable capability, allows a single display device 100 to meet the needs of a variety of applications without a user having to purchase several different specialized CRT or other custom monitors. The color space conversion circuit in the display device may use extended bit-depth hardware in order to faithfully perform the color space conversion to keep the shadow detail in images and to prevent color banding by providing smooth transitions between selectable colors.

The display device 100 may provide two or more modes of accurate color display. One mode is an excellent "native" mode that provides unmanaged performance of the display for color-managed environments in which the driving source provides the color space conversion based on the device color description reported by the EDID. Another mode is to provide accurate color space conversion in the device—e.g., an sRGB mode for driving sources whose only color management is to expect that the display will display an accurate sRGB response. Additional modes can be included in the display device.

Display Panel Requirements

Tone Response

In order to provide an accurate color, the most important attribute of the display panel 50, 50' is its precise tone response. Although the display device 100 may be capable of supporting several different tone responses, for many applications it is central to provide an sRGB specified tone response 12. The sRGB specification is casually referred to as a "gamma" of 2.2 to match that of conventional CRTs. However, as in FIG. 2, the actual specification for sRGB calls for a linear shadow region 16 connected to a region 14 which matches a gamma of 2.4 with an offset. The display panel 50, 50' will typically have three primaries such as Red, Green, and Blue filters in an LCD. Due to the arrangement of the filters in an LCD panel and their differing gap widths, the gamma response of the three primaries will vary somewhat. This variation is corrected in the front-end CSC electronics of the display device 100, generally in the post-LUT values. A targeted sRGB tone response per the sRGB spec is:

For all $\{RGB\}<=0.04045, \{R'G'B'\}=RGB*12.92$ (linear shadow region)

For all $\{RGB\}>0.04045, \{R'G'B'\}=((\{RGB\}+0.055)/1.055)^{2.4}$ (offset gamma of 2.4)

There are further requirements that the display panel 50, 50' should meet. The above targeted tone response curve should be monotonically increasing at all points. The maximum $\Delta L^*$ luminance difference (error) at any point along the tone response curve with respect to the ideal response at that input level (normalized to the peak white luminance) should be not more than 2. Further, when the driving source provides an 8-bit RGB data for all {R, G, B} (24 bit color) from 0 to 255, where R=G=B, the maximum $\Delta L^*$ luminance difference (error) should be not more than 0.6. Due to various factors such as filter design, primary excitation and pixel spacing, the display panel will likely not have identical chromaticity and tone response for each of the three primaries. Accordingly, the display panel 50, 50' may require unit-specific programming of tone response correction hardware within the display device 100.

Figure 3A:
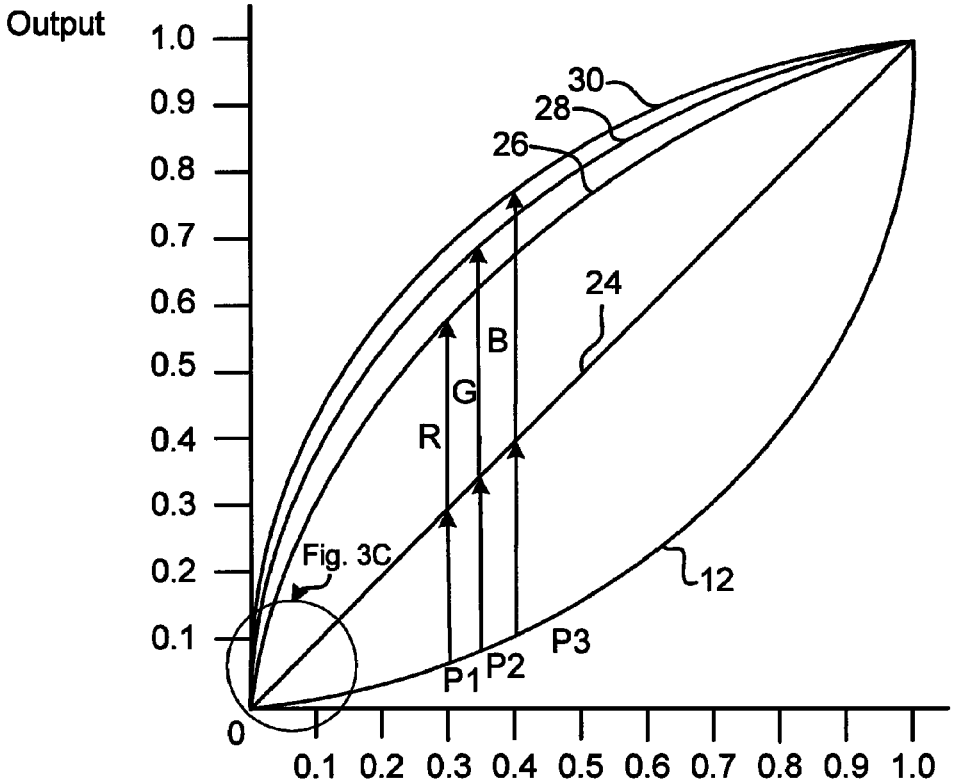
FIG. 3A is a diagram illustrating a set of transfer curves for a conversion from a gamma based color space into an ideal linear based color space to the native color space of a display panel in one embodiment.

FIG. 3A is an illustration of how the described embodiments receive an encoded input signal 20 having a sRGB gamma 12 that is the same for each of the primary inputs P1, P2, and P3 per sRGB spec. The gamma encoded inputs P1-P3 are decoded or otherwise transformed into a R'G'B' linear color space 24 having an extended bit-depth. For instance, the sRGB input primaries P1-P3 may each be represented as an 8-bit integer from 0-255 which may then be normalized to 0-1 as shown on the lower axis. The extended bit-depth for the R'G'B' linear color space 24 may be significantly higher such as a 12-bits. This will allow the transformation of the input color space to be converted to ideal native primaries R"G"B" using a 3×3 matrix linear algebra converter software or other logic. These ideal linear tone response are then encoded into the actual tone response for each of the native primaries 26, 28, and 30 of the display panel 50, 50' via a set of individual primary post-LUTs 62 (64, 66, 68), each having a separate and unique set of values for the table contents. Again, the Output 0-1.0 scale can represent a normalized 0-255 (8-bit/channel), 0-1024 (10 bit/channel) or other output from the CSC electronics to the display panel.

Figures 3B, 3C:
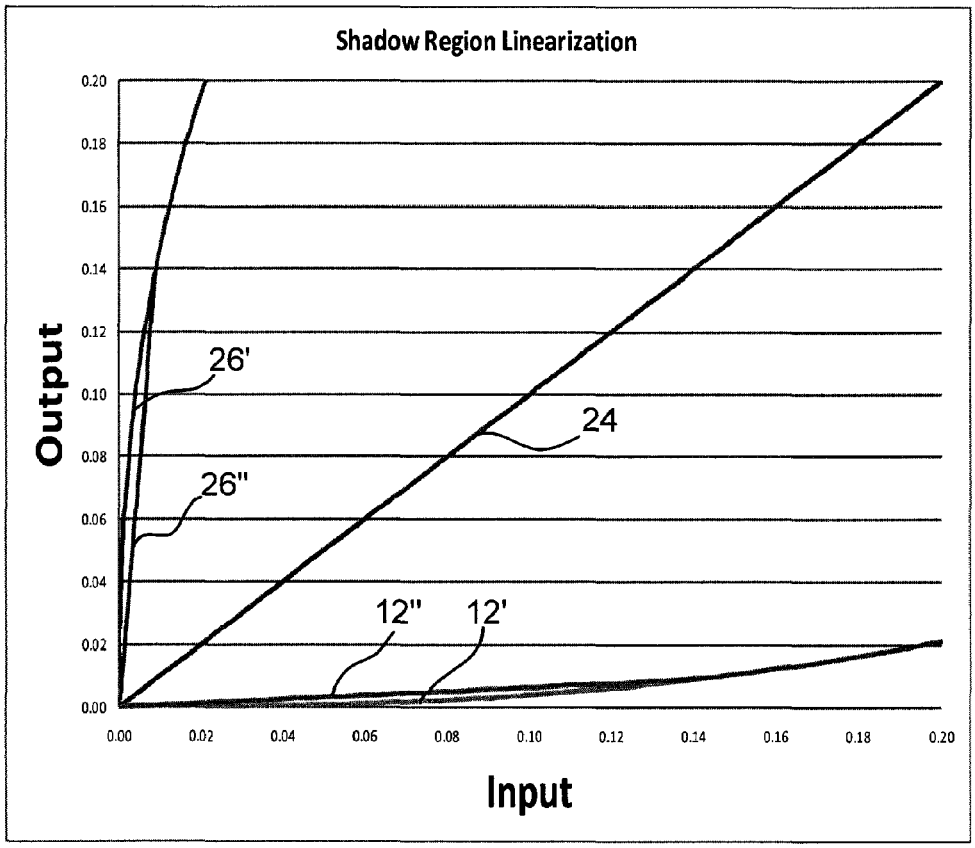
FIG. 3B is an exemplary pre-LUT look-up table for the first 50 values for both a simple 2.4 gamma and a shadow region corrected 2.4 gamma with a 0-255 8-bit input and a 0-1023 12-bit output in one embodiment.
FIG. 3C is an expansion of the shadow region of FIG. 3A illustrating the shadow region linearization in one embodiment.

FIG. 3B is an exemplary pre-LUT look-up table when sRGB is not used, such as for a simple 2.4 gamma color space in one embodiment of the invention. In this embodiment, shadow region look-up table values are compensated to allow for a smoother tone response when the input values are low by introducing a linear region differently than that done for sRGB which incorporates a linear region in the color space itself. The input value of the simple 2.4 gamma color space can range from 0-255 (only the first 10 values are shown for ease of discussion). Normally, the output values will have a very shallow slope near zero and numerous entries in the 2.4 gamma output table would contain duplicate values. In this embodiment, the output values can be corrected as shown in the corrected gamma output by linearizing the first 50 (10 shown) values while keeping the color error to a minimum of less than 4 bits (0-16) of the 12-bit resolution (0-4095).

FIG. 3C is an expansion of the shadow region of FIG. 3A for one embodiment in which the gamma encoded input signal is a simple gamma 2.4 signal 12'. The pre-LUT table values are linearized as in FIG. 3B to provide a linear section 12" to allow for the smoother tone response. Similarly, the post-LUT rather than having the values of the inverted 2.4 gamma native primary 26' has linearized values 26" (and likewise for other native primaries 28, 30) to allow the originally intended luminance to be replicated. As a result, by providing for the individual tone response correction for the display panel, the color accuracy is improved significantly allowing for additional tone response smoothing compensation in the shadow region when using limited bit depth image pipelines in the front-end CSC electronics. The consequence is the introduction of very little color error for simple gamma color space encoded signals. This shadow region linearization in the front-end CSC electronics provides the viewer a color accurate view for older conventional simple gamma color spaces comparable to that achieved with a modern sRGB color space that does the linearization within the color space itself.

Accordingly, the display device front-end CSC electronics can compensate for the differences in tone response between the three panel primaries by correcting for individual chromaticity and gamma, including compensation in the shadow region. By having the display device 100 neutral axis color drift imposed on the display device 100, the display panel 50, 50' specifications may be relaxed while still delivering superior color accuracy to the user of the display device 100. Relaxing the display panel 50, 50' specifications helps to reduce the cost of a display device 100 for both consumers and professional users.

Selection of Primary Chromaticities

Another requirement for the display panel 50, 50' is the selection of the display primary chromaticities (corners (vertices) of triangles 32, 34 in FIG. 4). The primaries used for the color filters on an LCD or the emission power spectrum of an emissive display should provide 100% coverage of the sRGB color space 36 as shown in FIG. 4 which is a representation of the 1931 CIE chromaticity diagram 40. Normally, this will require the display panel 50, 50' to have primaries with nominal primary locations sufficiently beyond the sRGB specification 32 as shown in FIG. 4. If other color spaces (such as Adobe™RGB 34) which to be encompassed by the accurate color rendition of the display device, the display panel primaries need to be chosen to encompass those color spaces in a similar fashion, such as by using a wide-gamut LCD or other wide-gamut display panel 50. Of course, a primary's chromaticity will vary slightly from panel to panel due to various manufacturing factors such as filter material and thickness, backlight selection and variance, etc. for an exemplary LCD display panel 50. So it is important for this manufacturing variation to be considered when specifying nominal primary chromaticities that will encompass the targeted color space on each manufactured unit.

White Point

A further consideration in the selection of a display panel 50, 50' is the panel white point, nominally $D_{65}$. Thus, when the Red, Green, and Blue primaries are at full scale, the panel should be designed such that the white point is nominally 6500 degrees Kelvin. For an LCD backlit display panel, this is typically done using a cold cathode backlight tube or multicolored LED intensity settings. With the display panel white point chromaticity specification set to (CIELUV 1976 u' v') 0.1978, v'=04.683, the variation in white point color in ΔC* chroma difference allowed is not more than 4 over the active area 52 of the display panel 50.

Color and Luminance Uniformity

As noted in the section off-axis consistency below, luminance uniformity is not a large factor in color accuracy as long as the gamma stays consistent. However, large variations in luminance uniformity across the viewing area of the display can cause objectionable complaints from users. Accordingly, the luminance variations should be such that all points on the display panel active area 52 are within 20% of a reference (such as full on white point) and that any such variation not be "visually objectionable." Visually objectionable is when to a casual observer it is more likely than not that the variation is visible and detracts from the image on the display.

Figure 5:
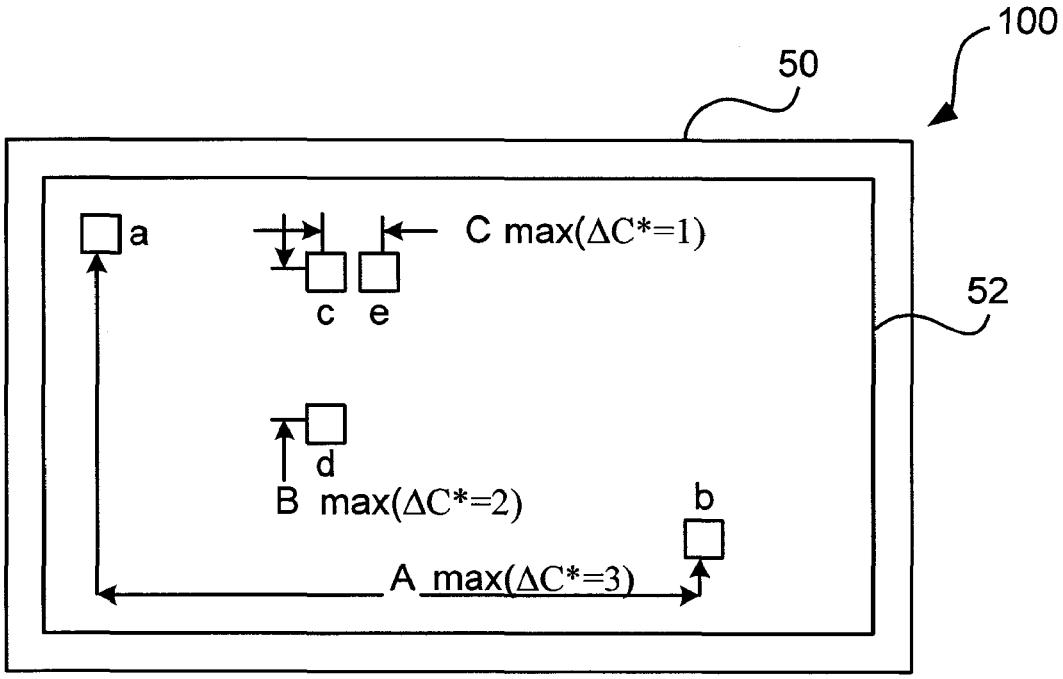
FIG. 5 is a front view of a display panel of a display device having an active area with several locations illustrated in one embodiment.
Figure 6:
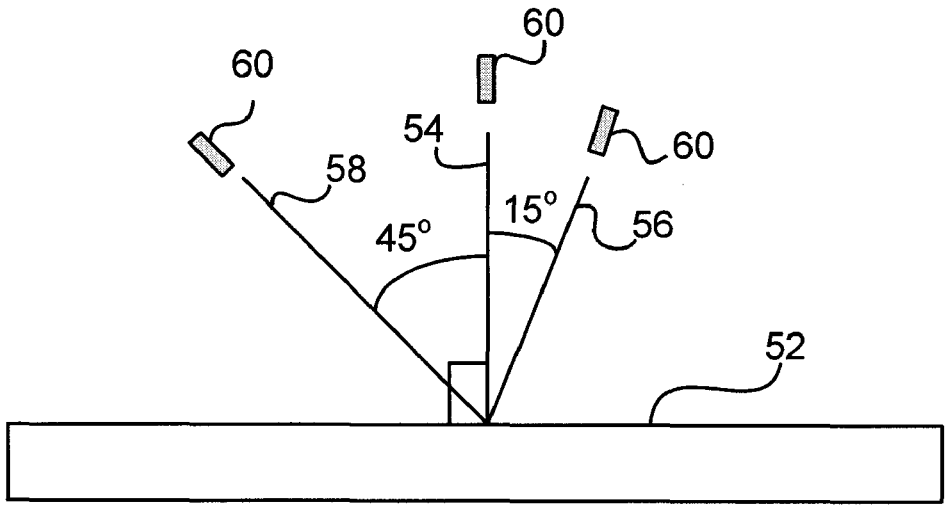
FIG. 6 and FIG. 7 are drawings of a side view and front view of a display device, respectively, illustrating exemplary locations and angles for sensing color from the display device in order to test or characterize the display device in at least one embodiment.

On the other hand, in an accurate color display 10, color uniformity requirements across the active viewing area 52 for a display panel 50, 50' is much stricter than that found in conventional display specifications. As illustrated in FIG. 5, there should be no more than a ΔC*=3 chroma difference between the measured color of any two locations in the active area 52 of the display panel 50, such as locations "a" and "b" separated by a distance "A". Further, there should be no more than ΔC*=2 chroma difference between the measures color of any given location and any other location with 5.0 cm of the first, such as with locations "c" and "d" separated by distance B. Finally, there should be no more than ΔC*=1 chroma difference between the measured color of any given location and any other location within 1.0 cm of the first, such as with locations "c" and e" separated by distance "C". The locations "a", "b", "c", "d", and "e" can be measured using a calibrated color sensor 60 known to those of skill in the art situated at the normal (perpendicular axis) of the location such as shown in FIG. 6.

Off-Axis Consistency

It is well known that some display technologies such as LCDs and rear projection displays have their overall luminance drop off as the viewing angle changes from the normal perpendicular viewing of the display panel 50. While an accurate color display 10 of the various embodiments is allowed to have the luminance change with respect to the viewing angle, the tone response should stay consistent within a defined range. This requirement means that the luminance of each of the primaries should fall off in a similar fashion such that an image viewed at various angles still has accurate color. To ensure that such a requirement is met, the display panel 50, 50' in the display device 100 should provide a set of performance criteria as follows when measured at angles of 15 degrees and 45 degrees as illustrated in FIG. 6:

@ 15 degrees from normal (axis 56, FIG. 6):

ratio of off-axis luminance to perpendicular luminance: >90% ratio of off-axis contrast ratio to perpendicular contrast ratio: >50% color difference of normalized off-axis color: $\Delta E^*_{ab94}$<=3

@ 45 degrees from normal (axis 58, FIG. 6):

ratio of off-axis luminance to perpendicular luminance: >50% ratio of off-axis contrast ratio to perpendicular contrast ratio: >25% color difference of normalized off-axis color: $\Delta E^*_{ab94}$<=8

Figure 7:
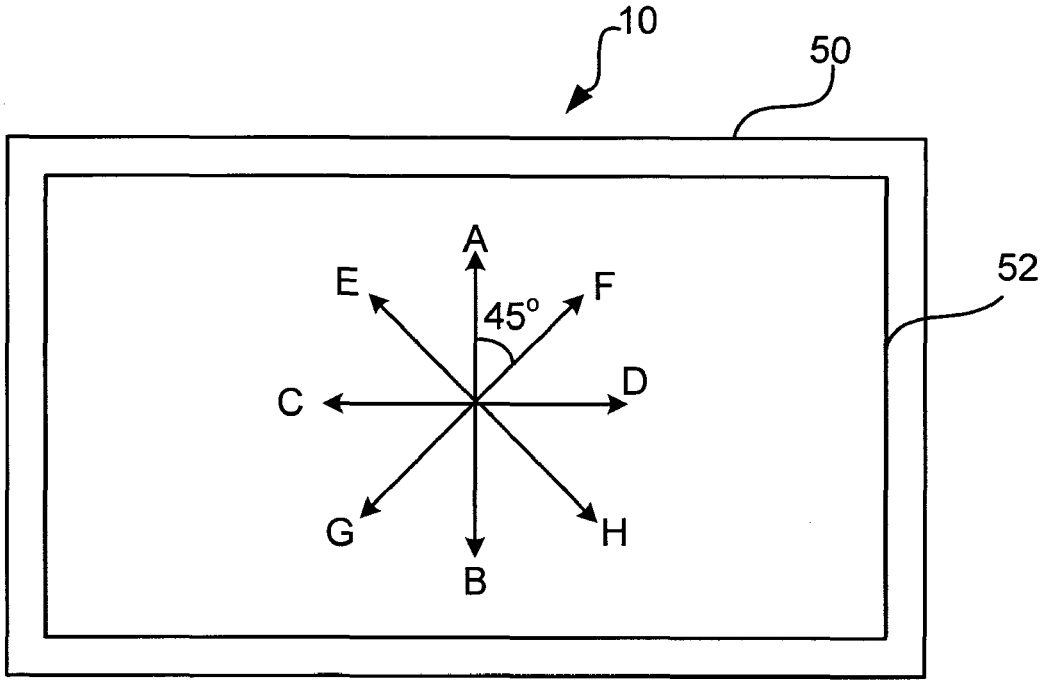

The off-axis color accuracy can be verified by using the calibrated color sensor 60 positioned at the normal axis (54), 15° off-axis (56), and 45° off-axis (58) from the active surface 52 of the display panel 50. To ensure that the accuracy is maintained about a rotation of the display panel 50, the color sensing should be done every 45° of display rotation as shown in FIG. 7 at positions A (top), B (bottom), C (left), D (right), E (upper left), F (upper right), G (lower left), and H (lower right) of the accurate color display 10. This rotational measurement should also be done for both the 15° and 45° off-axis color sensing angles illustrated in FIG. 6.

Display Panel Bit Depth

In order to properly reproduce the shadow detail in images and in order to provide for smooth transitions (no mach banding), especially in wide-gamut panels, the panel itself should have a sufficient bit depth. While 10-bit capability of the overall display device 100 is considered a good choice, this may be achieved by using 8-bit drivers in the display panel 50, 50' if the display device CSC electronics 11 (see FIG. 8) offers temporal dithering (FRC) (77-79) which can effectively add an additional 2 bits. Alternatively, the display panel 50, 50' may include the temporal dithering circuits.

Display Device Requirements

Although an excellent display panel 50, 50' is required as outlined above, the color front-end CSC electronics 11 used in the color space transformation from the driving device to the display panel 50, 50' should meet certain qualifications in order to provide the accurate color without creating various display "artifacts" which may be objectionable. The color space transformation CSC electronics 11 will typically include tone response compensation, including individual primary chromaticity and gamma compensation, as well as color space conversion and may include temporal dithering (FRC) as noted.

Color Space Conversion Electronics

In order to provide an accurate sRGB mode and to support other color spaces supported by the primary selection and gamut of the display panel 50, 50' chosen, the display device CSC electronics 11 may need to provide a series of color manipulations without introducing color errors or artifacts into the displayed image. While it may be possible to design a display panel 50, 50' with reasonably tight tolerances on the sRGB specification, this is typically not the case as most display panels 50 have difficulty providing specific primary chromaticity on a consistent basis. Accordingly, the inventors have chosen instead to specify a display panel 50, 50' that offers a wider gamut than the sRGB specification and then provide CSC electronics 11 in the display device 100 that manage the wider gamut of the display panel 50, 50' down to the desired color space selected.

This gamut management or mapping can be achieved with three functions:

I) A pre-LUT tone map that converts the incoming encoded RGB data to a linear R'G'B' color space. In other words, this pre-LUT provides the standard response curve for the target color space specification in question. Since all RGB color spaces of interest specify the same tone response for each of the primaries, the pre-LUT can be the same for all three primaries. If three pre-LUTs are used for convenience, then the table values in each should be the same.

Figure 8A:
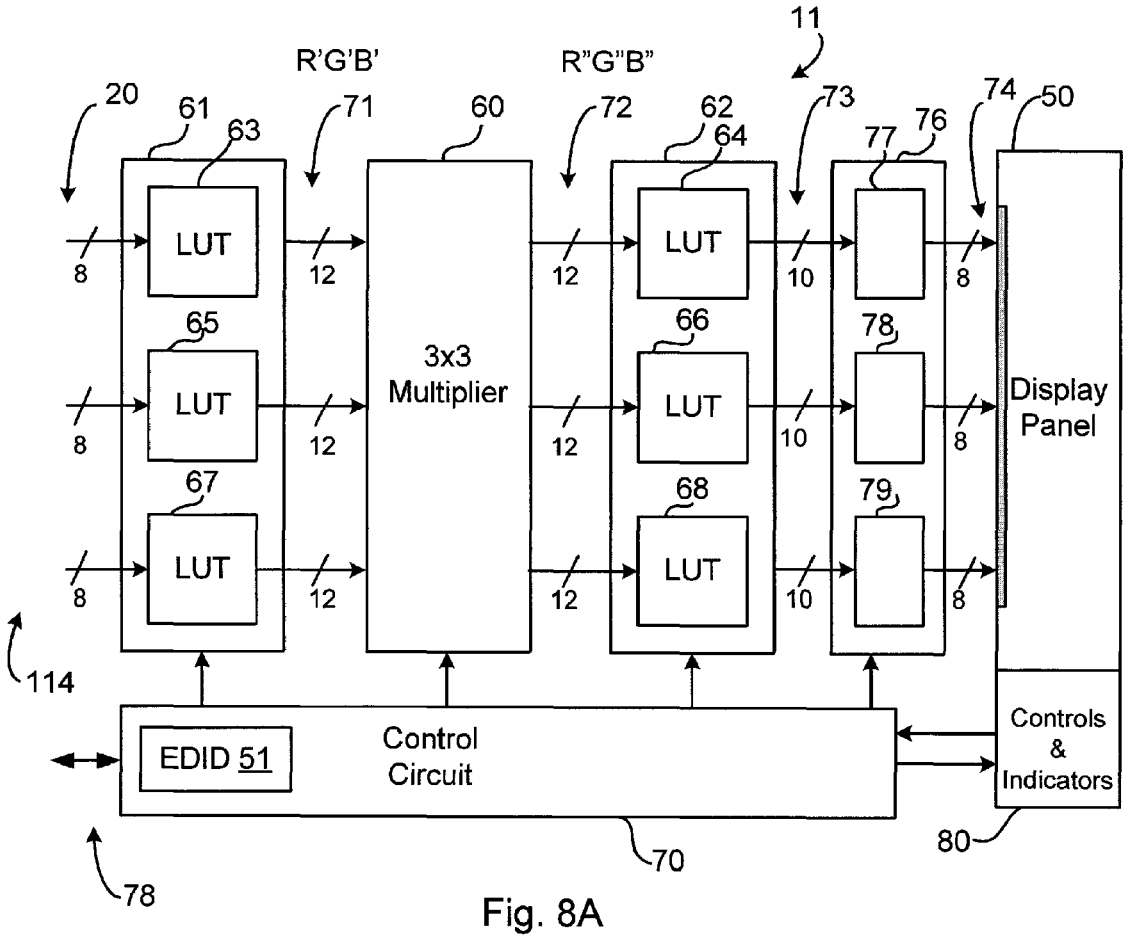
FIG. 8A is a schematic of an embodiment of a front-end color space transformation circuit in one embodiment used to ensure that a desired working color space is reproduced on the display accurately.
Figure 8B:
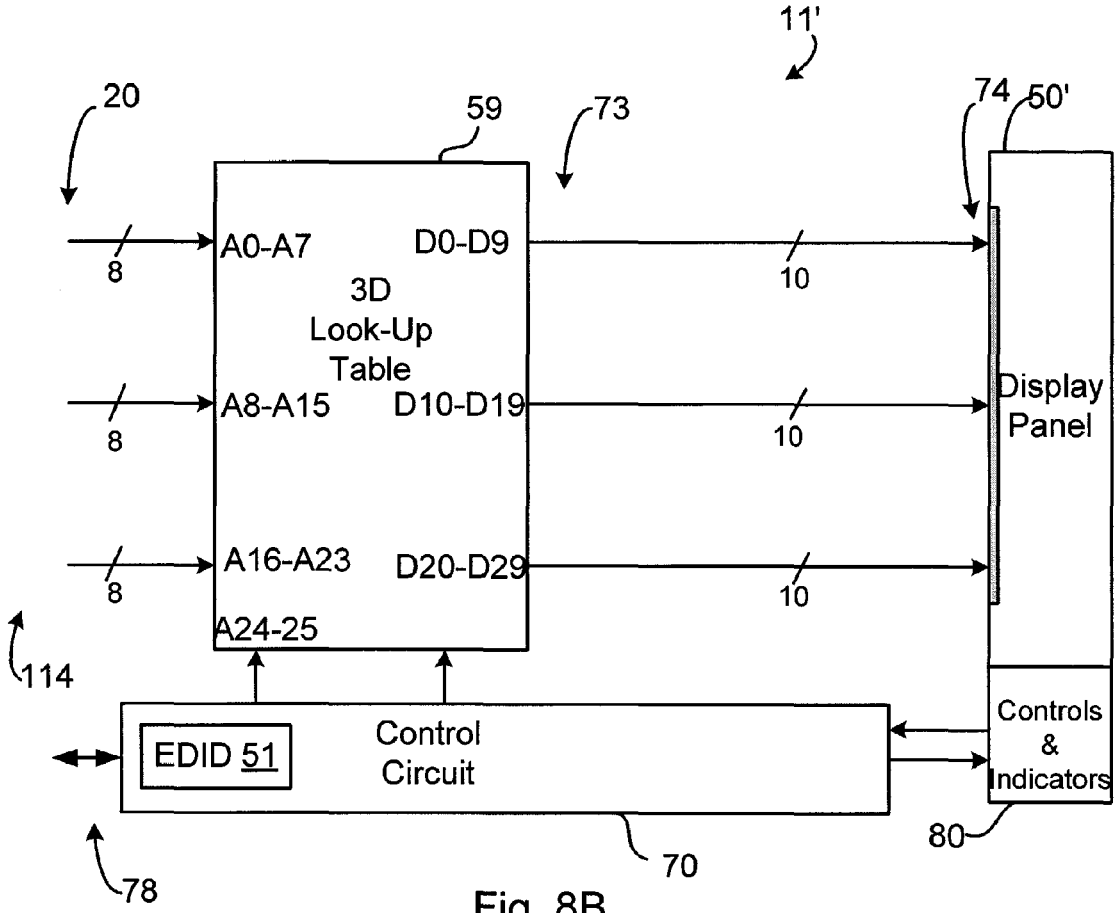
FIG. 8B is a schematic of another embodiment of a front-end color space transformation circuit used to ensure that a desired working color space is reproduced on the display accurately.

FIG. 8A is a schematic of an embodiment of a front end CSC electronics 11 circuit used to ensure colors are rendered on the display accurately and that sufficient bit depth is used to maintain such accuracy. As shown, the input data 20 has three 8-bit color channels that are presented to the decoder pre-LUT 61. The pre-LUT 61 may have one or more individual LUTs (63, 65, 67) used to decode each color channel to an extended bit-depth R'G'B' linear color space 71. Typically, most conventional color space standards use a single tone response for all three primaries so if more than one pre-LUT is used, they typically have the same values in the look-up tables. However, it is possible to have individualized gamma per primary and thus each pre-LUT could have different look-up table data. As shown in FIG. 8A, the output of the pre-LUT(s) 61 uses 12 bits or more.

One factor to consider when a simple gamma-encoded color space signals are received is that the slope of the pre-LUT curve(s) required to remove the gamma encoding is very shallow in the shadow region near zero. Without significant bit depth, numerous entries will contain duplicate values. Although this issue is known, the previous approach has been to design the color space to avoid it such as with sRGB as noted in FIG. 2 or to add more bits of resolution to avoid the loss of codes but adding to the cost of the device. While the sRGB color space specification has defined a linear region, other well known and established color spaces commonly define a simple gamma curve which is vulnerable to this issue resulting in a loss of unique values. The inventors have provided an unexpected technique to preserve the smoothness of tone response when using limited bit-depth resolution and simple gamma-encoded color space signals. This loss of unique values can be compensated for by introducing a linear region in the shadow region of the pre-LUT 61 and then inserting a compensating linear region in the post-LUT 62 such that the overall tone response can be much smoother in the shadows at the expense of a very minor color error which is tolerable given all the other color accuracy adjustments made with this new display architecture.

For example, a display device with incoming data encoded to a gamma of 2.4 and 8 bits per channel is decoded by a pre-LUT 61 with a 12 bit output resolution that is carried though the rest of the image pipeline. The pre-LUT 61 has 256 entries ($2^8$) of 12 bits each. Normally, a simple rounding in the conversion of the gamma 2.4 (see 12, FIG. 3A and FIG. 3B) to gamma 1.0 curve (see 24, FIG. 3A, and FIG. 3B) results in the first gray levels all being set to 0 and the next few levels all being set to 1, etc. By artificially lightening the pre-LUT 61 shadow values with a linear ramp more of the incoming data levels now have a unique value. To ensure that the overall tone response is accurate for gray values, the post-LUT 62 must be compensated similarly. This is done by having the post-LUT 62 loaded with a value that will give the originally intended luminance. The slope of the linear ramp may be varied depending on the gamma encoding of the incoming data. That is, shallower linear slopes are more appropriate for high gamma values.

2) A 3×3 Multiplier for converting the linear R'G'B' of the incoming color space to linear R"G"B" of the display panel's 50 actual primaries. The coefficients used in this matrix multiplier are derived from the tristimulus XYZ which describe the primaries of both the target color space and the actual measured "native" primaries provided by the panel. These therefore are programmed specifically for the individual display panel 50, 50' in question using characterization data of the panel primaries obtained in production or post-production. This characterization data is the primary chromaticity information measured for that individual panel. The coefficients used depend upon the relationship of the desired incoming color space and the actual measured native primaries of the display panel 50. For instance, the coefficients may be the result multiplying the conversion matrix from the incoming color space to CIE XYZ coordinates by the conversion matrix from CIX XYZ to the characterized primary locations and then scaled to allow the full range of brightness and $D_{65}$ white-point on the display but limiting the output values for the primaries normalized values to 0-1 (clipping negative and >1 values outside of the incoming color space.

The output of the pre-LUT(s) 63, 65, 67 are presented to a 3×3 multiplier 60 which performs a linear matrix conversion of the input extended bit-depth R'G'B' linear color space 71 to an idealized extended bit-depth R"G"B" linear color space which represents the actual measured primaries of the display panel 50. As shown in FIG. 8A, this idealized color space has 12 bits of resolution per primary channel. In one embodiment, the idealized color space is an ideal sRGB color space with the gamma as specified by the sRGB specification as noted earlier and decoded by the pre-LUT 61.

3) Three post-LUTs that essentially "linearize" the display panel's own native response such that the response curve as established by the pre-LUT 61 determines the overall response of the system. For instance, the post-LUTs 62 contain the inverse of the "measured response curves of the display panel" and thus compensate for each primary's individual gamma. Accordingly, since the display panel's tone response is slightly different for each of the three primaries, the table values in the three-post LUTs 64, 66, 68 will be similar but different. If the linear compensation is used in the shadow region of the pre-LUT 61 for the simple gamma encoded color spaces to provide smoother tone response, then the post-LUTs 64, 66, 68 need to have their table values adjusted with a compensating linear region with values that will provide the originally intended luminance taking into account the various individual gamma corrections for each color channel. Thus, the values in each of the post-LUTs may be slightly different.

The output of the 3×3 multiplier 60 is input into a set of individual and unique post-LUTs 64, 66, 68 to encode the idealized extended bit-depth R"G"B" linear color space to the actual primary gammas that have been characterized from the actual display panel 50. For instance, the display panel primaries may not each exactly follow the ideal sRGB specified gamma but only be a close approximation. By characterizing the display for each input on each primary and sensing the luminance output from the display, a graph of input levels vs.

output luminance for each primary can be plotted along with an ideal gamma and the data used to calculate an encoding scheme to create the ideal output for the ideal linear color space input (see FIG. 3A).

For "native mode", the pre- and post-LUTs (61 and 62) may be programmed to contain a simple 1:1 linear mapping of input to output and the 3×3 matrix is similarly set to a "unity matrix" such that the display panel's actual native primaries become the primaries of the device. Alternatively, the pre- and post-LUT tables may be used to cause the overall device response to more accurately match a given standard tone response, such as a simple gamma of 2.4, thus removing any response curve differences among the primary channels. Of course, the shadow region smoothing technique of introducing a linear region in the shadow region of the pre-LUT 61 and then introducing a compensating linear region in the post-LUT(s) 62 may be used to allow the overall tone response to be much smoother in the shadows in native mode with very minor color error.

FIG. 8B illustrates an alternative embodiment for the CPC electronics 11'. In this embodiment, the pre-LUT(s), 3×3 matrix, and post-LUTs are replaced with a 3D look-up table 59. Since the operation of the CPC electronics 11' is performing a mathematical operation on the input data and the input data has a limited number of inputs ($2^{24}$ for a 3×8-bit/color true color space as one example), the result of the mathematical operation can be pre-calculated using the characterized data for a 10 bit/color channel display panel 50' and the results for each transformation of input data stored in a 3D look-up table, such as a programmable memory. The programmable memory may be read-only or re-writable depending on the desired application. In addition, the memory may contain multiple stored 3D look-up tables to support multiple color spaces. Further, the programmable memory may be made of one or more memory integrated circuits. The 3D look-up table may also be implemented algorithmically by using a processor running computer executable code from computer readable memory that is organized to provide instructions and data for the processor to perform this task.

Control circuit 70 is used to provide timing to control the 3D look-up table 59. The video input signals 20 in this embodiment are 8-bits/color channel and are used as addresses A0-A23 to the memory in the 3D look-up table 59. Additional address such as A24-A25 can be used to select multiple color spaces (here $2^2$ or 4 color spaces). The memory shown has 30 bits of encoded output 73, 10 for each color channel which are used to drive the input port 74 of display panel 50'. As each display device 100 includes a distinctly programmed 3D look-up table, the individual gamma correction for each primary of display panel 50' is compensated for in the values stored in the 3D look-up table for each color space.

The math used to calculate the pre-LUT, 3×3 multiplier, post-LUT and 3D look-up table values or coefficients can be derived from the following:

$[X, Y, Z]^T=[M_{CS}]([R_{CS}, G_{CS}, B_{CS}]^T)^{1/\gamma_{CS}}$ to transform the input color space to a linearized set of CIE XYZ tri-stimulus values, where $M_{CS}$ is a 3×3 matrix of coefficients for the conversion.

$[R_D, G_D, B_D]^T=[M_D][X, Y, Z]^T$ to convert the CIE XYZ tri-stimulus values to the idealized linear color space primaries of the display panel 50, where $M_D$ is a 3×3 matrix of coefficients derived from the measured color values characterized for each display panel 50, 50'.

$[R_D', G_D', B_D']^T=[R_D^{\gamma_{rd}}, G_D^{\gamma_{gd}}, B_D^{\gamma_{bd}}]^T$ where $\gamma_{rd}$, $\gamma_{gd}$, and $\gamma_{bd}$ are the individual gammas of the display panel 50, 50' native primaries.

Note: the 3×3 matrix coefficients ($M_{3\times3}$) for FIG. 8A can simply be:

$$[M_{3\times3}]=[M_D]*[M_{CS}]$$

Note also that the pre-LUT 61 and post-LUT 62 values can be adjusted as needed (see FIGS. 3B-3C) to provide the appropriate linear slope to smooth the tone response in the shadow regions as noted earlier. Likewise, the 3D look-up table 59 coefficients or algorithms may also be compensated similarly to provide the same functionality of smoother shadow region tone response.

Bit Depth

The entire image pipeline in the CSC electronics 11 in FIG. 8A should be at least 12 bits wide per color if the display device accepts 8-bit encoded.

In addition, the full brightness and dynamic range of the display panel should be used when in sRGB mode with no reduction in luminance beyond what is necessary to accurately map the primaries and the white point.

As shown in FIG. 8A, the output of the post-LUTs 64, 66, 68 have 10 bits of resolution but more or less can be generated depending on the input requirements of the display panel 50, 50' input port 74. As noted, if the display panel 50, 50' does not accept 10 bit input per primary, a set of dithering circuits 76 (77, 78, 79) can be used to temporally modulate the display panel 8-bit inputs to achieve similar perceptual resolution. FIG. 8A shows the display panel as having 8 bit per channel inputs but any input bit per channel input such as 10-bit or 12-bit would still meet the claimed subject matter. Also, when using higher bit-depths, one may forgo the use of the dithering circuits 76. In addition, some display panels may implement the dithering circuits 76 and thus they may not be included in the front-end color space conversion circuitry in some embodiments.

The front end CSC electronics 11 may include a control circuit 70 having a control interface 78, for instance an $I^2C$ bus and other display timing signals can be used to communicate with a driving source (see FIG. 1, 22) which creates the input signals 20. The control circuit 70 provides the proper timing and control of the color conversion pipeline to ensure that the data presented on input signals 20 are properly converted to the actual color space of display panel 50. The control circuit 70 may be coupled to the pre-LUT 61, the 3×3 multiplier 60, the post-LUTs 62, and the dithering circuits 76, if present. In addition, the control circuit 70 may be coupled to the display panel 50, 50' to provide appropriate timing and clock signals as well as various indicators and receive selection of various options from user controls on the display panel 50, 50' or display device 100. The control circuit 70 may also contain memory or other logic to create the EDID information 51 for the display device 100.

Unit Specific EDID

The display device 100 should provide correct EDID information 51 per VESA standard(s) for all modes and color space inputs supported. Each display device's EDID should contain data which is accurate for the particular display device (i.e. primary, white point, response curve (gamma values), etc). These EDID values should be measured and adjusted for that particular device following a warm-up time and final calibration on the production line.

When the display device 100 is being used by a user and the user modifies the selected color space of the display, the EDID information 51 should be updated to reflect the currently selected preset color space. For instance, it will be changed to reflect the native mode characteristics when in native mode and will reflect the sRGB specification when in sRGB mode and similarly for other color spaces that are supported.

User Interface Requirements

The various embodiments of the display device 100 may include controls (including remote controls) and indicators 80 for the user which allow for selection between the various color management options and the Native mode of the display device 100. An on-screen display or other indicator should be provided to allow the user to view and select the desired color space setting including Native mode.

Accurate sRGB Mode

In sRGB mode, the display device 100 should be designed, measured, and programmed such that in its as-shipped condition, after a minimum of 30-minute warm-up period, the display device 100 does not exhibit a color error of greater than 3 ΔC*chroma difference as compared to the sRGB specification for any primary, secondary, or neutral axis color at any point over a full range "grayscale" ramp. In sRGB mode, for all {RGB}, $\Delta E^*_{ab94}$ color difference should be not more than 5 with respect to the sRGB specification.

When in sRGB mode, the target primaries and white point should be:

| sRGB spec | u' | v' (1976 u' v' coordinates) |
|---|---|---|
| White ($D_{65}$) | 0.1978 | 0.4683 |
| Red | 0.4507 | 0.5229 |
| Green | 0.1250 | 0.5625 |
| Blue | 0.1754 | 0.1579 |

Tone Response

Native Mode Preset

The display device 100 embodiments of the claimed subject matter should have a "native mode preset." This mode is expected to be used in a color managed workflow with appropriate color profiles that reflect a particular unit's actual performance, in order to maintain color accuracy. The color profile may be generated by creating a file based on the display device 100 unit-specific primary, white point, and gamma data as characterized and stored in the device's EDID. Rather than managing the wider gamut of the display panel 50, 50' to an defined color space such as sRGB, the full gamut of the display panel 50, 50' can be managed by a smart application that can read the measured and characterized values of the display panel's primary chromaticities and gamma that are stored and reported in the EDID when in this "native preset mode."

Native Tone Response

The display device 100 should have primary values that encompass the sRGB gamut. The primary values and the white point (which may be influenced by a light source such as a backlight) are expected to exhibit stable primary behavior consistent with the values measured in the characterization of the display and stored in the display device's EDID. The default white point for a display device should match the $D_{65}$ illuminant as noted above in 1976 u'v' coordinates.

In Native mode, the display device 100 should be designed, measured or characterized, and programmed such that in an as-shipped condition, after a 30 minute warm-up period, the display device does not exhibit a color error of greater than 3 ΔC*chroma difference, as compared to the information stored in the display device's EDID for any primary, secondary, or neutral-axis color at any point over a full-range "grayscale" ramp.

In Native mode, for all {R, G, B}, the $\Delta E^*_{ab94}$ color difference should be not more than 5 with respect to the color space defined by the display device's primaries, white point, and gamma as described in the display device's EDID.

Tone Response Mapping

As noted previously, the display device CSC electronics 11 provides a tone response mapping function that maps the actual tone response of the display device 100 to the tone response of the desired color space. Separate tone response maps should be used for each of the three primaries in the post-LUT circuits 62 to compensate for the differences in the gamma response and chromaticity between the three primaries.

In both sRGB mode and Native mode, the display device 100 should provide a tone response that matches the sRGB specification. If other color space presets are offered, then the tone response of the display device 100 should comply with the tone response of the specified color space.

The neutral-axis colors, where R=G=B should exhibit minimal hue and saturation error and drift relative to the nominal white point color. Any color drift from neutral should be smooth and consistent such that a gray-ramp test target should exhibit no objectionable color bands.

Figure 9:
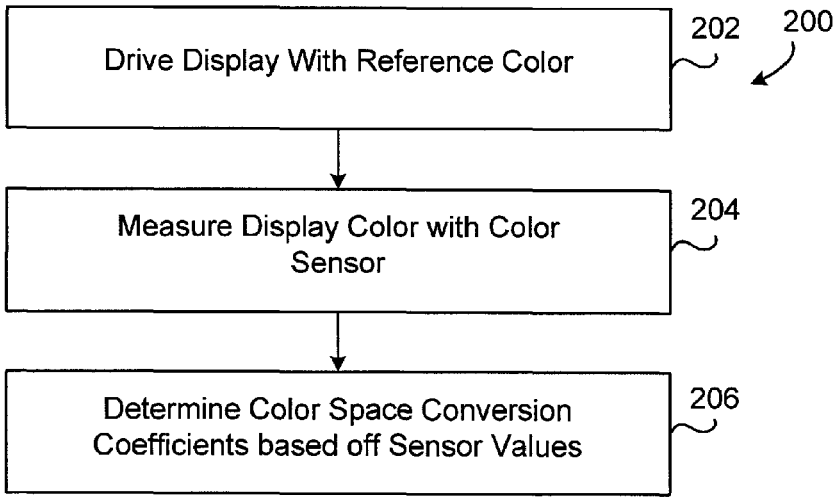
FIG. 9 is a flow chart of a characterization method to program the post-LUT values in order to represent the output of the display in an idealized linear color space in one embodiment.

FIG. 9 is a flow chart 200 of a characterization method to program the post-LUT 62 table values and 3×3 multiplier 60 coefficients in order to represent the output of the display in idealized linear color space in one embodiment. For each of the reference colors the display panel is driven with the appropriate input signal as in step 202. In step 204, for each reference color, the display panel 50, 50' is measured to the display device specifications as noted below. In step 206 an ideal post-LUT value is determined based off the sensed color and what is required to have the input driven to in order for the display panel to meet the display device specifications below and incorporating the shadow region smoothing technique as needed for each simple gamma color space. Based off the chromaticity value of the primary measured, the 3×3 multiplier coefficients are calculated for each color space supported by display device 100 with respect to the ideal specified primary chromaticity for a desired color space.

Display Device Specification

Target tone response per sRGB spec:

For all {RGB}<0.04045, {R'G'B'}={RGB}*12.92

For all {RGB}>0.04045, $\{R'G'B'\}=((\{RGB\}+0.055)/1.055)^{2.4}$

The curve should be monotonically increasing at all points.

The maximum luminance error at any point along the curve, with respect to the ideal response at that input level (normalized to the peak white luminance) should result in a ΔL* luminance difference of not more than 2.

No noticeable mach banding: When provided 8-bit RGB data for all {R, G, B} from 0 to 255, where R=G=B, between any two adjacent levels the ΔL* luminance difference should be not more than 0.6.

Neutral-axis color drift:

For all {R, G, B} where R=G=B, the maximum ΔC* chroma difference should be not more than 3 relative to the input data specification color space (i.e. sRGB).

For all $\{R_n, G_n, B_n\}$ where $R_n=G_n=B_n$ and $G_n-20<=G<=G_n+20$, the difference between RGB and should demonstrate a ΔC* chroma difference of not more than 0.7.

In one exemplary embodiment, a display device 100 is configured to have a front face having an active area 52 of a set of native primaries 73 that encompass at least one enhanced color space having a gamut greater than an sRGB color space gamut. The display device 100 has a perpendicular luminance and a perpendicular contrast ratio along a perpendicular axis 54 and can be characterized by:

a) providing a set of signals 114 representing a desired color space to a port 112 on the display device 100, b) sensing a color signal and luminance for each of the set of signals 114, and c) computing a specified tone response including a set of 3×3 multiplier coefficients and a set of at least 3 post-LUT coefficients for the display device 100 for each of the set of native primaries 73 for each of the set of input video signals 20 wherein the response is monotonically increasing at all points and wherein the maximum luminance error at any point along the tone response with respect to an ideal response at a given second input level normalized to a peak white luminance is a ΔL* luminance difference of not more than 2, and wherein when the color space is represented as an 8-bit data for each primary, from 0 to 255, the ΔL* luminance difference should be not more than 0.6 between any two adjacent levels when the primaries are set to equal levels.

Alternative Color Spaces

Figure 10:
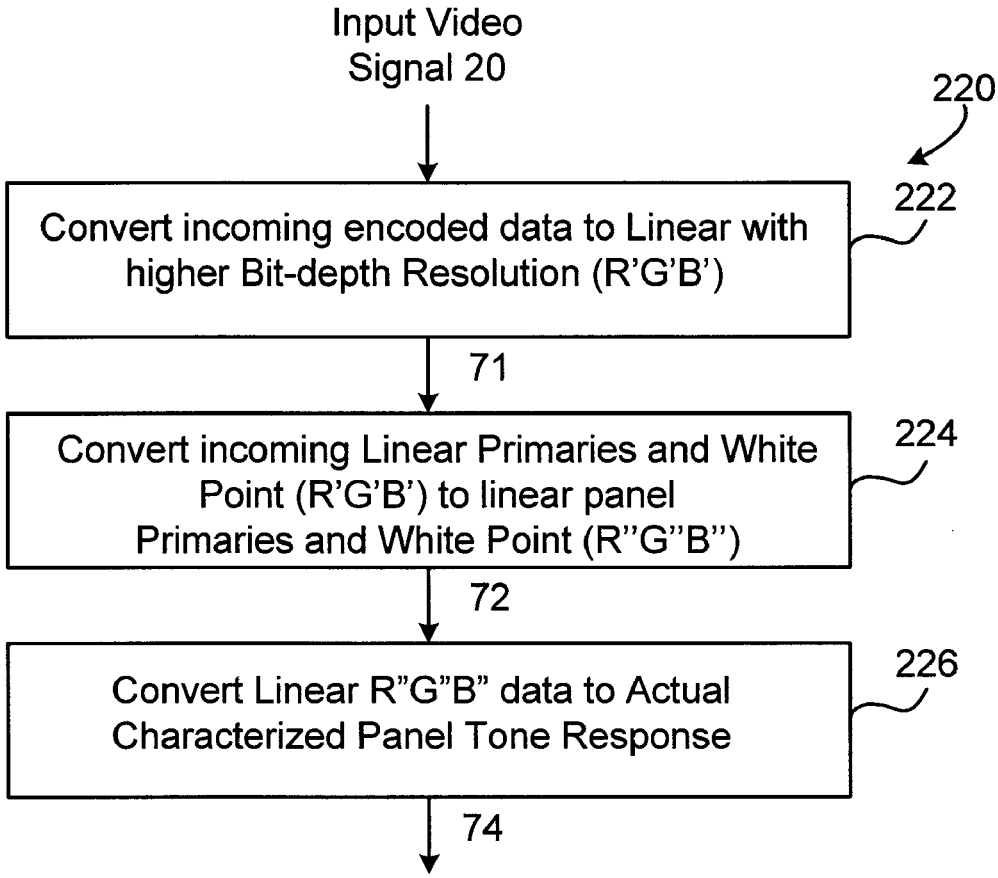
FIG. 10 is a flow chart of a method of using the display to convert a desired color space into accurate colors produced by the display in one embodiment.

FIG. 10 is a flow chart 220 of a method of using a display to convert a desired color space into accurate colors produced by the display device 100 in one embodiment. Other color spaces may be provided in the display device 100 to allow for other color space presets in addition to the sRGB used as a "managed" color space. Some exemplary alternative color spaces in which the primaries may be chosen to include are:

Adobe™ RGB with simple gamma of 2.2 with no offset

Digital Cinema (DCI) "P3" ref. projector spec. with a simple gamma of 2.6 with no offset ITU Rec. 601 ("SMPTE-C") with a simple gamma of 2.4 with no offset ITU Rec. 709 (HDTV) with a simple gamma of 2.4 with no offset A driving source 22 (FIG. 1) provides a desired encoded color space to the input port of the display device 100. In step 222, the display device converts the desired encoded color space to the extended-bit R'G'B' linear color space using pre-LUT 61 (FIG. 8) and may include the technique of smoothing the color space in the shadow region. If so, then a linear region is introduced in the shadow region of the pre-LUT 61. In step 224, the 3×3 multiplier 60 or other equivalent circuit or software is used to convert the extended-bit R'G'B' linear color space with a first white point from encoded primaries to linear R"G"B" ideal primaries and second white point for the display panel 50. These linear R"G"B" ideal primaries are converted (by encoding) in step 226 to the display panel's actual measured tone response or characterized color space correcting for any difference in individual tone response, primary chromaticity, possible linear shadow region compensation, and maybe other display panel 50, 50' errors. The linear shadow region correction for the pre-LUT is compensated by inserting a compensating linear region in the post-LUT 62. Alternatively, a 3D look-up table 59 can be used to provide the functionality of FIG. 10 by having all the steps precalculated and loaded as coefficients in the 3D look-up table 59.

While the present invention has been particularly shown and described with reference to the foregoing preferred and alternative embodiments, those skilled in the art will understand that many variations may be made therein without departing from the spirit and scope of the invention as defined in the following claims. This description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements.

What is claimed is:

1. A color accurate display device configured to receive an encoded first color space having a first gamut from a set of encoded primaries {R, G, B} and a first white point, comprising:

a display panel having an active area configured for an encoded second color space having a second white point and a set of native primaries each with a characterized tone response with respect to the second color space and a measured tone response from the display panel, the native primaries having a second gamut larger than and including the first gamut; and a color space conversion circuit configured to:

linearize any gamma encoded primaries in a shadow region of the first color space to the shadow region of the second color space, subsequent to linearizing the gamma encoded primaries in the shadow region, convert the set of encoded primaries {R, G, B} and first white point of the first color space to the set of native primaries and second white point compensating for each characterized tone response of the second color space, and linearize the converted native primaries in the shadow region to compensate for any subsequent gamma encoding of the native primaries by the display panel, wherein the color space conversion circuit converts the encoded primaries from a first bit resolution in the first color space to a second bit resolution in the second color space, the second bit resolution being greater than the first bit resolution.

2. The display device of claim 1, wherein for all {R, G, B} with respect to the first color space and the measured tone response from the display panel, the $\Delta E_{ab94}$ color difference is less than 5 and where R=G=B, the ΔC* chroma difference is not more than 3, and when provided 8-bit RGB data from 0 to 255 for the encoded primaries {R, G, B}, the ΔL* luminance difference between any two adjacent levels is not more than 0.6 when the encoded primaries {R, G, B} are set to equal levels.

3. The display device of claim 2, wherein the display panel is further configured to have a maximum ΔL* luminance difference at any point along a measured tone response of the display panel with respect to an ideal response at a given input level for the first color space normalized to a peak white luminance is not more than 2.

4. The display device of claim 1, wherein the active area has a perpendicular luminance and a perpendicular contrast ratio along a perpendicular axis, the display panel further having an off-axis viewing consistency characterized wherein:

the off-axis viewing consistency at 15 degrees from perpendicular to the active area the off-axis luminance is greater than 90% of the perpendicular luminance, and the off-axis contrast ratio is greater than 50% of the perpendicular contrast ratio, and the off-axis $\Delta E_{ab94}$ color difference of normalized off-axis color is not more than 3; and the off-axis viewing consistency at 45 degrees from perpendicular to the active area an off-axis luminance is greater than 50% of the perpendicular luminance and the off-axis contrast ratio is greater than 25% of the perpendicular contrast ratio, and the off-axis ΔEab94 color difference of normalized off-axis color is not more than 8 when measured in each of eight angles equally subtended about the perpendicular axis.

5. The display device of claim 1, wherein the display panel has a color uniformity characterized wherein for a) any two locations within the active area the measured ΔC* chroma difference not more than 3; and b) any given location and any other location within 5.0 cm the ΔC* chroma 20 difference is not more than 2, and c) any given location and any other location within 1.0 cm the ΔC* chroma difference is not more than 1.

6. The display device of claim 1, further comprising a control circuit configured to allow for individually settable tone responses for at least two preset color spaces with respect to for the first color space, each preset color space having a gamut that is included in the gamut of the second color space.

7. The display device of claim 6, wherein at least one of the individually settable tone responses is a simple gamma function in the shadow region.

8. The display device of claim 6, further comprising an EDID circuit configured to provide an EDID signal that is dynamically updated to reflect a current tone response for the first color space.

9. The display device of claim 1, wherein the first bit resolution is 8 bits per color and the second bit resolution is 10 bits per color or greater.

10. The display device of claim 1, wherein the first bit resolution is 8 bits per color and the second bit resolution is 12 bits per color or greater.

11. A method of making an accurate color display device, comprising the steps of:

providing a color space conversion circuit coupled to a first port supporting a first color space with {R, G, B} primaries having a first tone response and a first white point and coupled to a second port supporting second color space; and providing a display panel coupled to the second port and having an active area of a set of native primaries reflecting the second color space with multiple characterized tone responses for each native primary and a second white point, the second color space having a gamut larger than and enclosing a gamut of the first color space, the display panel having a perpendicular luminance and a perpendicular contrast ratio along a perpendicular axis to the active area, wherein the color space conversion circuit is configured to:

linearize any gamma encoded primaries in a shadow region of the first color space to the shadow region of the second color space, subsequent to linearizing the gamma encoded primaries in the shadow region, convert the set of {R, G, B} primaries and first white point of the first color space to the set of native primaries and second white point compensating for the first tone response and each characterized tone response of the second color - space, and linearize the converted native primaries in the shadow region to compensate for any subsequent gamma encoding of the native primaries by the display panel, wherein the color space conversion circuit converts the {R, G, B} primaries from a first bit resolution in the first color space to a second bit resolution in the second color space, the second bit resolution being greater than the first bit resolution.

12. The method of claim 11, further including the step of testing the display panel to verify a specified tone response wherein for all {R, G, B} primaries:

with respect to the first color space and a measured tone response from the display panel, the $\Delta E_{ab94}$ color difference is not more than 5 and where R=G=B, the ΔC* chroma difference is not more than 3, and wherein when the second color space is represented as an 8-bit data for all primaries, from 0 to 255, the ΔL* luminance difference is not more than 0.6 between any two adjacent levels where R=G=B.

13. The method of claim 12, further comprising testing the display panel to verify a specified tone response wherein the maximum ΔL* luminance error at any point along the measured tone response with respect to an ideal response {R, G, B} at the first port normalized to a peak white luminance is not more than 2.

14. The method of claim 11, further comprising testing the display panel to verify a color uniformity characterized wherein for any two locations within the active area the measured ΔC* chroma difference is not more than 3 and wherein any given location and any other location within 5.0 cm the ΔC* chroma difference is not more than 2, and wherein any given location and any other location within 1.0 cm the ΔC* chroma difference is not more than 1.

15. The method of claim 11, further comprising testing the display panel to verify an off-axis viewing consistency when measured in each of eight angles subtended equally around the perpendicular axis, wherein at 45 degrees from perpendicular to the active area an off-axis luminance is greater than 50% of the perpendicular luminance, an off-axis contrast ratio is greater than 25% of the perpendicular contrast ratio, and the off-axis $\Delta E_{ab94}$ color difference of normalized off-axis color is not more than 8.

16. The method of claim 15, wherein at 15 degrees from perpendicular to the front face the off-axis luminance is greater than 90% of the perpendicular luminance, the off-axis contrast ratio is greater than 50% of the perpendicular contrast ratio, and the off-axis $\Delta E_{ab94}$ color difference of normalized off-axis color is not more than 3.

17. The method of claim 11, wherein the first bit resolution is 8 bits per color and the second bit resolution is 10 bits per color or greater.

18. The method of claim 11, wherein the first bit resolution is 8 bits per color and the second bit resolution is 12 bits per color or greater.

* * * * *

UNITED STATES PATENT AND TRADEMARK OFFICE

CERTIFICATE OF CORRECTION

PATENT NO. : 8,654,142 B2
APPLICATION NO. : 13/258501
DATED : February 18, 2014
INVENTOR(S) : Ed Beeman et al.

It is certified that error appears in the above-identified patent and that said Letters Patent is hereby corrected as shown below:

In the Claims

Column 23, line 1, in Claim 4, delete "ΔEab94" and insert -- $\Delta E_{ab94}$ --, therefor.

Column 23, line 8, in Claim 5, before "not" insert -- is --.

Column 23, line 10, in Claim 5, after "chroma" delete "20".

Signed and Sealed this
Seventh Day of October, 2014

Michelle K. Lee

Michelle K. Lee
*Deputy Director of the United States Patent and Trademark Office*